United States Patent [19]

Nelson et al.

[11] Patent Number: 4,505,179

[45] Date of Patent: Mar. 19, 1985

[54] LINE THROWING DEVICE

[75] Inventors: Steve Nelson; Frank Reynolds, both of Grand Rapids, Mich.; George E. Roos, Burns Flat, Okla.; John Ball, Conklin, Mich.

[73] Assignee: Walker Limited Partnership, Comstock Park, Mich.

[21] Appl. No.: 404,546

[22] Filed: Aug. 2, 1982

[51] Int. Cl.[3] ..... F42B 13/56; F41F 1/04

[52] U.S. Cl. ..... 89/1 G; 42/1 F; 42/1 L; 102/504; 441/85

[58] Field of Search ..... 89/1 G, 1 F, 1.817, 89/1.818, 1.819; 42/1 F, 1 L; 102/371, 504; 441/85

[56] References Cited

U.S. PATENT DOCUMENTS

| | | | |
|---|---|---|---|
| 192,670 | 7/1877 | Backus | 102/504 |
| 289,909 | 12/1883 | Griffin et al. | 102/504 |
| 1,257,126 | 2/1918 | Schneider | 89/1 F |
| 2,111,374 | 3/1938 | Sedgley | 89/1 G |
| 2,388,749 | 11/1945 | Pierre | 89/1 G X |
| 2,471,353 | 5/1949 | Schermuly et al. | 102/504 |
| 2,521,655 | 9/1950 | Schermuly et al. | 102/504 |
| 2,805,622 | 9/1957 | Cammin-Christy | 102/504 |
| 3,468,214 | 9/1969 | Worcester et al. | 89/1 G X |
| 3,583,087 | 6/1971 | Huebner | 89/1 G X |
| 4,327,644 | 5/1982 | Stancil | 89/1 G X |

FOREIGN PATENT DOCUMENTS

| | | | |
|---|---|---|---|
| 1110050 | 6/1961 | Fed. Rep. of Germany | 89/1 G |
| 1147634 | 4/1956 | France | 89/1 G |

*Primary Examiner*—David H. Brown
*Attorney, Agent, or Firm*—John A. Waters

[57] ABSTRACT

A line throwing device adapted to be launched from a riot gun or similar tubular launching device comprises an elongated projectile that fits in the tubular launching device, a fin assembly slidably mounted on the body of the projectile such that the fin assembly slides forwardly to permit the rear end of the projectile to be positioned in the launching device for launching and slides rearwardly to a flight stabilizing position at the rear of the projectile as the projectile is launched from the tubular launching device. A rocket engine is mounted in the rear of the projectile for propelling the projectile. An ignition mechanism comprising a conventional shotgun primer cap mounted in a plastic casing fits on the end of the rocket and is ignited by the trigger and firing pin of the gun. A line is coiled in a canister removably attached to the gun, with one end of the line being attached to a harness mounted on the projectile so that the line can be carried to the desired target.

16 Claims, 8 Drawing Figures

LINE THROWING DEVICE

BACKGROUND OF THE INVENTION

1. Field of the Invention

The present invention relates to a rocket powered line throwing device that is adapted to be launched from a conventional riot gun or similar tubular launching device.

2. Description of the Prior Art

For many years there has been a long standing need for an accurate, moderately priced line throwing device capable of carrying a rescue line a substantial distance. Such devices are needed in water rescue operations as well as land operations wherein an exemplary use might be to carry a line to a top of a building or an inaccessable cliff on a mountain for rescue purposes.

The devices presently used for this purpose have serious drawbacks. One such device employs a long brass or steel rod that is discharged from the barrel of a rifle launcher by means of a rifle shell. The kick from the shell is so strong that it has been known to break the shoulder of the operator. Moreover, a long rod shot from a gun presents something of a safety hazard to the person who hopes to be rescued. In addition, the rod sinks, which makes it undesirable for water rescue operations, and has other defects.

Another line throwing device designed for marine rescue operations includes a relatively fat, buoyant nose cone, and a rocket drive motor that fits in the barrel of a pistol shaped launching device. The rocket is launched by a blank shotgun shell as in the previous line thrower. The explosive force of the shotgun shell poses a significant safety hazard because it can cause the rocket to blow up in the gun. Also, the shotgun shell produces a severe kick, and the projectile has poor directional accuracy or stability.

Other types of line throwing devices also are in use. These have various disadvantages in terms of accuracy, distance, cost, ease of operation, or safety. Further, most of the such devices require special launching devices which add further and substantial expense to the system.

An important object of the present invention is to provide an accurate, moderately priced, safe line throwing device that can be launched from a conventional riot gun or similar device that is already in widespread use and application by public institutions for launching flares, tear gas grenades, or other such applications. Another important object of the present invention is to provide a rocket powered line throwing device of the type described wherein the explosive force used to ignite the rocket engine is minimized so as to maximize the safety of the device and minimize the kick on the gun.

SUMMARY OF THE INVENTION

In accordance with the present invention, a line throwing device adapted to be launched from a tubular launching device such as a riot gun comprises a projectile including an elongated body shaped to fit in the tubular launching device; a fin assembly including outwardly extending stabilizing fins slidably mounted on the body for axial movement along the body, with the fin assembly sliding forwardly to permit the rear end of the projectile to be positioned in the tubular launching device and sliding rearwardly to a flight stabilizing position as the projectile is launched from the tubular launching device; a rocket engine mounted at the rear of the projectile; an ignition mechanism for selectively igniting the rocket engine; and a line having one end that is carried by the projectile from the launching device to the projectile target area for rescue purposes or the like.

In the present invention, the projectile is a tubular device having a tapered nose-cone and an outwardly flared rear end, and the fin assembly comprises an annular sleeve that slides along the tubular assembly, with stabilizing fins extending outwardly from the sleeve. The tubular body of the projectile fits in the barrel of the launching device, but the fin assembly does not. The fin assembly thus slides forwardly on the projectile when it is loaded in the launching device and then slides rearwardly to its most stable guiding position at the rear of the projectile when the projectile is launched.

The projectile is powered by a rocket engine that fits in the rear end of the projectile, with a nozzle formed in the rear end of the engine facing outwardly from the projectile. The rocket engine is ignited by means of a conventional shotgun shell primer cap mounted in a special molded plastic casing that fits on the end of the rocket engine. The casing and outlet nozzle of the rocket engine are formed so that a relatively minor explosive force produced by the primer cap is sufficient to ignite the rocket engine. The primer cap is detonated by a conventional trigger and firing pin apparatus of the launching device.

The line is contained in a canister that is removably clipped on the gun launcher, thus permitting the gun to be used for other purposes when not being used as a line throwing device.

These and other advantages of the present invention will hereinafter appear and for purposes of illustration but not of limitation, a preferred embodiment of the present invention is described below and shown in the appended drawings.

DETAILED DESCRIPTION OF PREFERRED EMBODIMENTS

Figure 1:
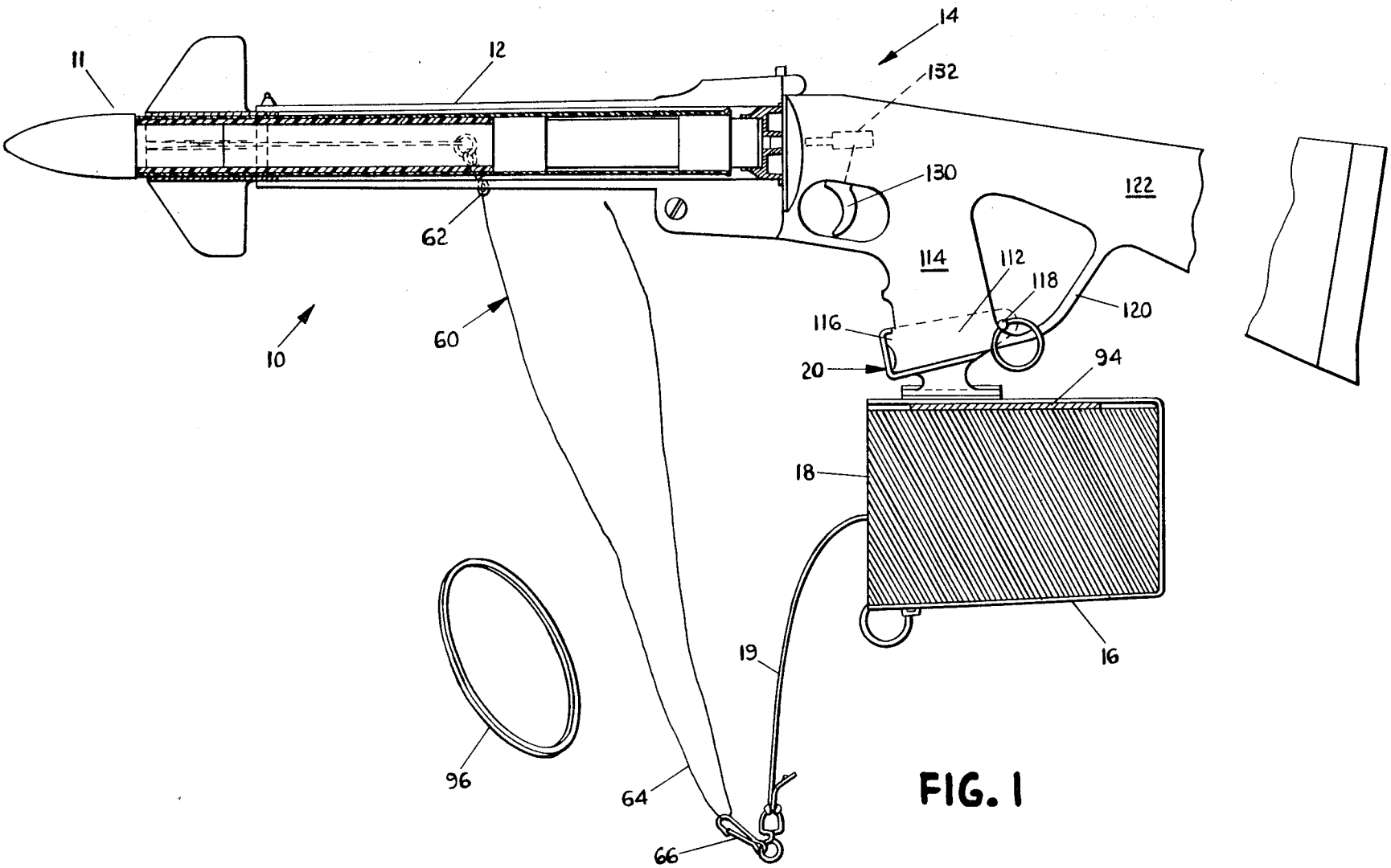
FIG. 1 is a partially sectional side elevational view of the line throwing device of the present invention mounted in a conventional riot gun.

Referring to the drawings, FIG. 1 shows a line throwing device 10 constructed in accordance with the present invention mounted in the barrel 12 of a conventional riot gun 14. The particular brand of riot gun shown in FIG. 1 is manufactured by Federal Laboratories, Inc., Saltsburg, Pa. and is already in widespread use throughout the country for other purposes. Other brands of riot guns or similar launching devices that are presently in use also could be employed with the present invention although in some cases dimensional modifications might be necessary. It is an important feature of the present invention, that the present line throwing device can be launched from conventional riot guns or similar launching devices so that persons who already have such riot guns can equip themselves with a line throwing device for rescue operations or the like without the purchase of additional, expensive launching hardware.

The line throwing device further comprises a canister 16 containing coiled line 18, which is mounted on a handle mounting clip 20 that can be releasably attached to the gun.

The portion of the line throwing device 10 that is propelled through the air is projectile 11. As shown in detail in FIGS. 2, 3, and 6 projectile 11 comprises an elongated body 22 and a slip fin assembly 24 mounted for slidable axial movement along body 22. A tapered nose-cone 26 formed of balsa wood or the like fits in an open front end of body 22.

Figure 3:
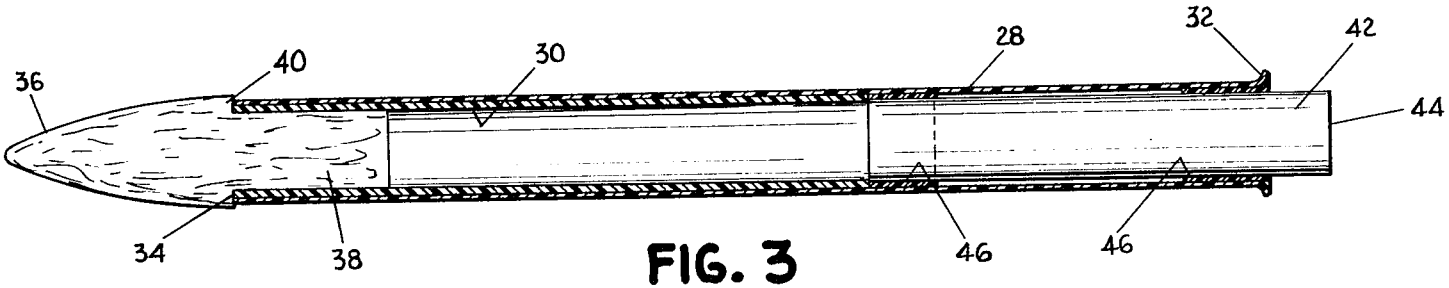
FIG. 3 is an axial cross-sectional view of the body of the projectile.

As shown in FIG. 3, body 22 comprises an outer tube 28 extending the length of the body and an inner tube 30 that fits snugly within the outer tube. Both tubes are formed of moldable PVC plastic and have a circular cross-section. Outer tube 28 has an outwardly flared rear end 32 that serves as a stop mechanism to prevent the slip fin assembly from sliding off the rear of the body. The inner tube helps to balance the projectile and serves as a stop for the rocket engine.

Nose-cone 26 fits in an open front end 34 of the body with the nose-cone including a tapered front portion 36 and a cylindrical rear portion 38 that fits snugly within inner tube 30. The nose-cone is formed of balsa wood or the like and preferrably is painted with a highly visible vinyl paint such as optic orange or the like (as is the rest of the projectile). The rear end 40 of the tapered front portion 36 of the nose-cone extends outwardly beyond the outer periphery of the body. This prevents the slip fin assembly from sliding over the nose-cone and off the body when the projectile is pointed downwardly.

A rocket engine 42 is positioned in the rear end of outer tube 28 with a rear end 44 of the engine projecting slightly beyond the rear end of the outer tube. Inner tube 30 extends rearwardly from the front end of the body to a rear end that serves as a stop means to limit the inward movement of the rocket engine into the body. Rocket engine 42 engages the rear end of tube 30 to properly position the rocket engine in the projectile. Centering tubes or collars 46 fit over the rocket engine to position the rocket engine snugly in the projectile with the rocket engine being in axial alignment with the projectile itself. This snug fit and accurate placement of the rocket engine in the center of the projectile improves the accuracy of the projectile. It also provides a somewhat air tight compartment in the body, which improves buoyancy.

Figure 6:
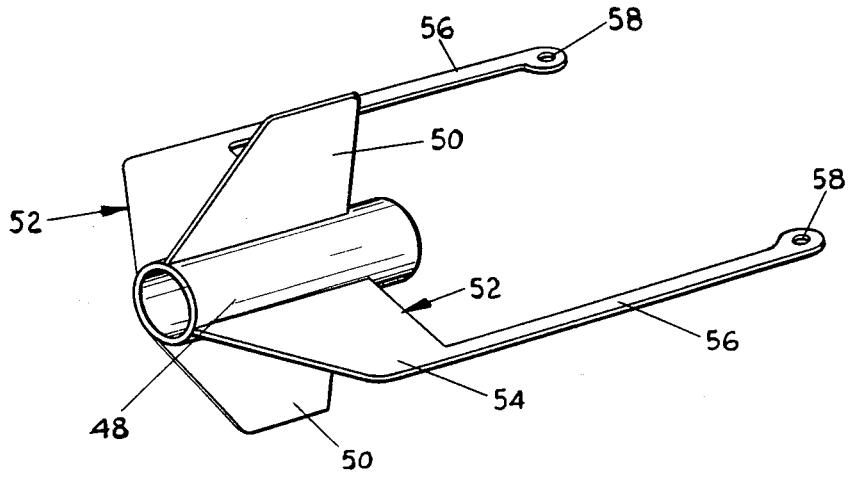
FIG. 6 is a perspective view of the slip fin assembly of the present invention.

As shown in FIG. 6, slip fin assembly 24 comprises a central sleeve 48 that fits over outer tube 28 of the body. Sleeve 48 is slidable along outer tube 28 between the outwardly extending portion 40 of the nose-cone and the flared end 32 of the outer tube. Two sets of stabilizing fins 50 and 52 extend radially outwardly from sleeve 48 at equally spaced intervals around the tube. Fins 50 comprise directional fins on opposite sides of the sleeve that are adapted to be positioned in a vertical plane. Fins 52 are harness fins and include front fin portions 54 similar to directional fins 50 and trailing arms 56 that extend backward along the body of the projectile. Openings 58 at the rear ends of arms 56 are adapted to be connected to a harness 60 (see FIGS. 1 and 2) by means of suitable ring or hook type fasteners 62.

Figure 2:
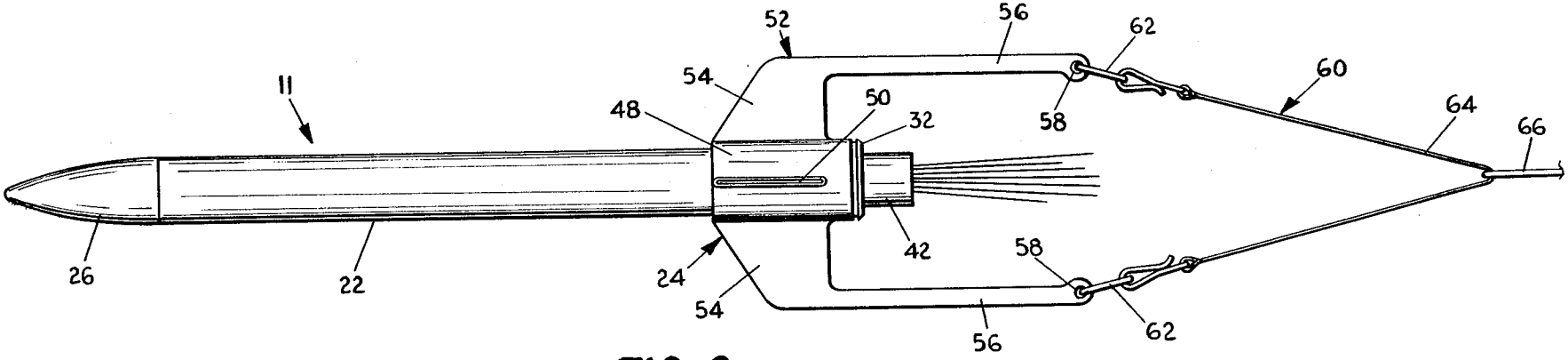
FIG. 2 is a plan view showing the projectile of the present invention in flight.

Harness 60 comprises a stainless steel cable that extends between the openings 58 in the respective harness fins, with the harness fins being positioned on opposite sides of the sleeve and adapted to be mounted in a horizontal position in the launching device. The harness has a looped central portion 64 that is of sufficient length that it trails behind the projectile when the projectile is in flight (FIG. 2). The central portion is attached to the end 19 of line 18 by means of a swivel snap hook 66 attached to the end of the line.

The action of the slip fin assembly in the operation of the line throwing device is illustrated in FIGS. 1 and 2. As shown in FIG. 1, when the rear end of the projectile is inserted into the barrel of the gun, the slip fin assembly slides forwardly toward the front of the body, thus permitting the end of the projectile to be inserted fully into the gun. When the projectile is propelled from the gun, however, the slip fin assembly slides to the rear of the projectile and nests against flared end 32 in the manner shown in FIG. 2. The fins are in an improved position for controlling aerodynamic stability of the rocket when they are positioned in the manner at the rear of the rocket during flight.

Figure 5:
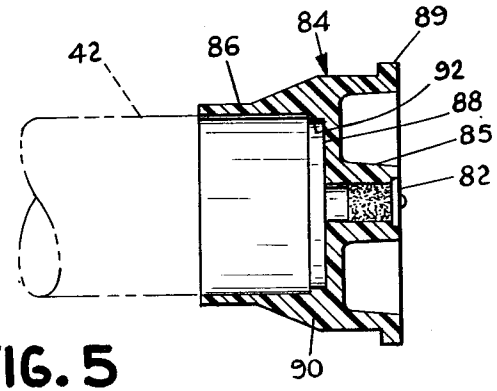
FIG. 5 is an axial cross-sectional view of the primer casing of the present invention.
Figure 4:
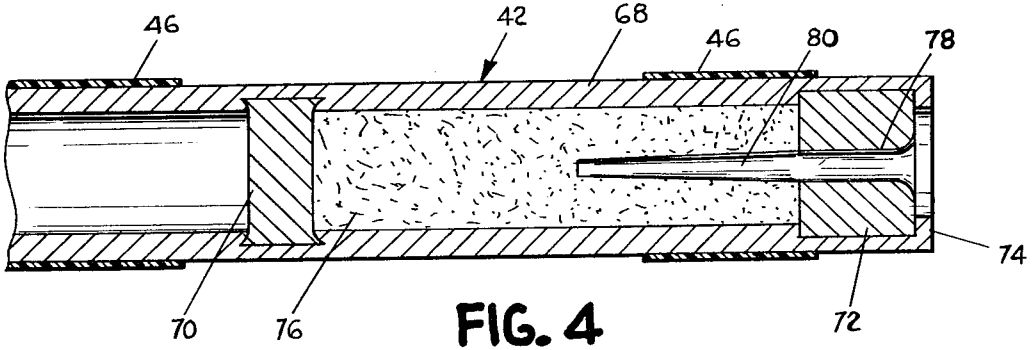
FIG. 4 is an axial cross-sectional view of the rocket engine of the present invention.

A more detailed illustration of rocket engine 42 is shown in FIG. 4, and the manner in which it is detonated is shown in FIG. 5. Engine 42 comprises a tubular paper outer casing 68 with a ceramic bulkhead 70 positioned at the forward end of the rocket engine and a ceramic nozzle 72 positioned at the rear end of the rocket engine. An inwardly extending end portion 74 of the outer casing extends over the outer edges of nozzle 72. The cavity between the bulkhead and the nozzle is filled with a solid fuel propellant 76 that is selected so as to provide a strong initial thrust and then an even continuous thrust for the period of time while the projectile is designed to be in motion. A continuous, even force on the projectile optimizes performance of the line throwing device. This is called a pre-programmed, variable thrust engine and is important in providing flight stability while withdrawing line at a controlled rate of speed. A burn time of about 3–4 seconds, preferably 3.6 seconds, is desirable for a line about 600–700 feet long.

A solid propellant identified by United States Military Specification Number MIL-P-663A or one of substantially equivalent ballistic qualities performs particularly well in the rocket engine of the present invention.

Nozzle 72 of the present invention includes a nozzle opening 78 extending inwardly through the end of the nozzle. The outer end of the nozzle opening is rounded and flared outwardly. The nozzle opening then tapers inwardly through the nozzle and extends into the propellant itself, leaving an elongated opening or cavity 80 extending into the propellant. This opening facilitates ignition of the propellant by a relatively tiny detonation charge.

The size of the nozzle opening is an important feature in making it possible to detonate the engine with a small shotgun shell primer cap. If the opening is too small, the engine will not ignite; if the opening is too large, the detonation would be too rapid. In the preferred engine, which is six inches long and about one inch in diameter, a nozzle opening of 0.235–0.245 inches in diameter and about 2.29–2.31 inches deep is desirable.

The rocket is detonated by a primer cap such as a conventional shotgun shell primer cap 82. As used herein reference to a shotgun shell primer cap includes any other type of primer cap having similar characteristics to a shotgun shell primer cap. Primer cap 82 is mounted in a moldable plastic casing 84. The casing includes an annular outer shell 86 and a base plate 88, with reinforcing ribs 90 extending between the base plate and the shell. The base plate 88 includes an outer flange 89 that extends beyond the outer edges of the shell, and is engaged in the breach of the gun in the manner shown in FIG. 1. Primer cap 82 is centered in an opening in the middle of end plate 88 and faces directly into the flared opening 78 in the nozzle of the rocket engine. The inner diameter of outer shell 86 of the casing is sufficiently large so that the rocket engine smoothly, yet snuggly, fits in the casing. An inner portion 92 of the shell immediately adjacent the base plate of the casing has a slightly smaller inside diameter that engages the rocket engine as it is inserted into the casing. This spaces the engine a small, predetermined distance from the primer cap. Desirably, portion 92 is about one-tenth inches wide such that the end of the rocket engine is spaced this distance away from the end of the casing.

With the casing and rocket constructed in the manner described above, it is feasible to detonate the rocket engine with the small explosive charge provided by a conventional shotgun shell primer cap, such as the type manufactured by Winchester-Western Division of Olin Manufacturing. Because the explosive charge of the primer cap is so small, the riot gun has virtually no kick in launching the projectile. Further, the danger of an explosion of the rocket caused by the excessive explosive force presented by shotgun blanks characteristically used in such applications is eliminated.

In operation, after primer cap ignition, the initial thrust of the rocket engine causes ejection of the projectile from the gun. The projectile then proceeds under an even thrust until the projectile has been carried the desired distance. The gradual rocket thrust protects the operator from being burned by the exhaust from the rocket engine.

Line 18 is a braided nylon line desirably having a diameter of approximately 0.89–0.99 inches and having a minimum breaking strength of approximately four hundred pounds (400 lbs.). The line is wound in a universal wind and is positioned in a molded plastic canister 16. The line is wound such that the outer end of the line extends outwardly from the center of the line and the line can be continuously unwound by pulling the line from the center. A sponge rubber padding 94 positioned between the ball of line and the wall of the canister will hold the line in position in the canister while it is being unwound. The canister is enclosed by a snap lid 96 for storage or when the line throwing device is not in use.

The snap lid on the canister is a significant departure from prior line throwers. In some prior devices, the line container is covered by a lid having a relatively small central opening through which the line extends. The whole lid comes off in the present invention, and thus prevents any portion of the lid from restricting unwinding of the line. Any significant restriction can significantly affect the flight characteristics of the projectile. The lid can be removed entirely without the line falling out because the sponge rubber padding resiliently holds the line in the canister.

Figure 7:
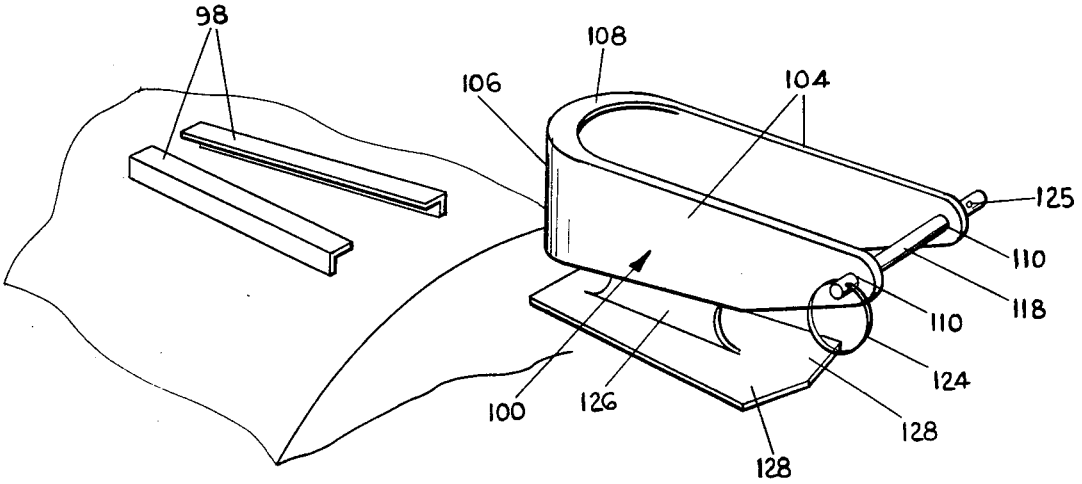
FIG. 7 is a partial perspective view showing the manner in which the canister mounting bracket attaches to the handle mounting clip of the present invention for mounting the canister to the hand grip of the riot gun.
Figure 8:
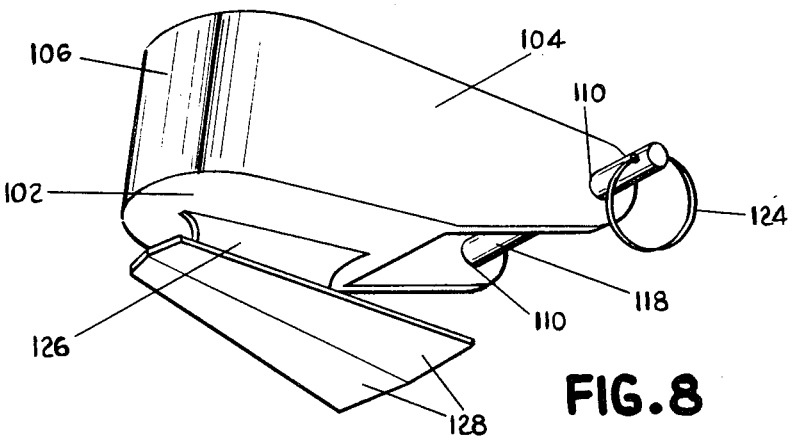
FIG. 8 is a perspective view of the handle mounting clip of the present invention.

As shown in FIGS. 1, 7 and 8, the canister is removably mounted on the gun by means of a handle mounting clip 20 that fits into a pair of L-shaped flanges 98 mounted on the top of the canister. The L-shaped flanges taper inwardly at the forward end of the canister so as to provide a snug fit for the handle mounting clip. Desirably the L-shaped flanges are integrally molded into the canister.

Handle mounting clip 20 comprises a cup shaped portion 100 having a bottom 102 and side walls 104 extending longitudinally along the clip. An end wall 106 is formed in a forward end of the clip with an inwardly directed flange 108 positioned at the upper end of wall 106. The rear end of the clip is open and includes a pair of aligned openings 110 therein.

As shown in FIG. 1 cup 100 fits over butt 112 of a hand grip 114 on the rifle. Flange 108 fits over finger ridges 116 in the front edge of the hand grip, and a quick release pin 118 extends through aligned openings 110 at the rear portion of the cup. A support flange 120 extends between the butt of the hand grip and the stock portion 122 of the rifle that is placed against the shoulder. The quick release pin fits over the flange so that it locks the cup on the hand grip.

Pin 118 comprises a cylindrical pin having a pull ring 124 at one end and a spring loaded ball latch 125 at the other end to lock the pin releasably in position between the walls of the cup. The pin can be removed simply by pulling the pull ring to release the cup from the hand grip of the gun. This permits the gun to be reconverted easily to use as a riot gun or a flare gun or the like.

A mounting flange for attaching the canister to the clip is mounted on the bottom of the cup portion of the handle mounting clip. The mounting flange comprises a downwardly extending leg portion 126 and outwardly extending arms 128. Arms 128 are tapered inwardly in a forward direction so that they fit into the inwardly tapered channel flanges on the canister. The channel flanges are formed of a resilient plastic material so that arms 128 can be wedged snugly in the mounting flanges on the canister.

With the foregoing mounting mechanism, a conventional riot gun can easily be converted to use with a line throwing device by simply clipping the handle mounting clip on the handle with the quick release pin 118 and then clipping the canister on the mounting clip.

To launch the line throwing device of the present invention, a rocket engine with attached casing is first loaded in the gun through the breach, with the flanges on the casing being wider than the barrel and being locked in the breach when the barrel is closed. The projectile is then fitted inwardly into the barrel of the gun so that the rocket engine slides into the rear end of the projectile. The lid is then removed from the canister and the line clipped to the central portion of the harness by snap hook 66. The projectile is then aimed and fired by means of the conventional trigger 130 and firing pin 132 of the riot gun (shown schematically in FIG. 1). The firing pin detonates the primer cap and this causes the projectile to be propelled toward its target trailing the nylon line after it.

The projectile is formed of light weight materials, and the balsa nose-cone causes the projectile to float if it lands on water.

The foregoing structure provides a light weight and accurate line throwing device that is safe and easy to use.

It should be understood that the foregoing embodiment is merely exemplary of the preferred practice of the present invention and that various modifications and changes may be made in the arrangements and details of construction of the embodiment disclosed herein without departing from the spirit and scope of the present invention.

The embodiments of the invention in which an exclusive property or privilege is claimed are defined as follows:

1. A line throwing device adapted to be launched from a tubular launching device such as a riot gun comprising:

a projectile including an elongated body shaped to fit in the tubular launching device and a fin assembly, including outwardly extending stabilizing fins, slidably mounted on the body for axial movement along the body, the fin assembly sliding forwardly to permit the rear end of the body to be positioned in the tubular launching device and sliding rearwardly to a flight stabilizing position as the projectile is launched from the tubular launching device, the projectile body comprising two interfitting tubes, an inner tube being mounted at a forward end of an outer tube and extending only a part of the way toward the rear end of the outer tube;

rocket engine means mounted at the rear end of the projectile for propelling the projectile, the rocket engine and interfitting tubes being formed such that the rocket engine fits into the outer tube but not into the inner tube, the rearmost end of the inner tube serving as a stop to limit inward movement of the rocket engine into the body and to maintain the rocket engine at the rear of the projectile;

ignition means mounted at the rear end of the rocket engine for igniting the rocket engine; and, a line having one end that is carried by the projectile from the launching device to the projectile target area for rescue purposes or the like.

2. A line throwing device according to claim 1 and further comprising centering tube means encircling the rocket engine to provide a snug fit between the rocket engine and the outer tube and to accurately center the rocket engine in the outer tube.

3. A line throwing device according to claim 1 wherein the fin assembly is mounted on the outer tube, the rear end of the outer tube having an outwardly extending flange that restrains rearward movement of the fin assembly, a floatable nose cone fitting in the front end of the outer tube, the nose cone having an outwardly extending rear portion that restrains forward movement of the fin assembly on the outer tube, the flange at the rear of the projectile fitting closely in the tubular launching device but the outer tube being spaced from the inner walls of the tubular launching device, the fin assembly including outwardly extending fins mounted on a sleeve that fits on the outer tube, the sleeve including a rear portion extending rearwardly from the fins, the rear portion fitting closely in the outer end of the tubular launching device and serving to center the projectile in the tubular launching device.

4. A line throwing device according to claim 1 wherein the rocket engine fits only partly in the rear end of the projectile and includes a rear portion that protrudes outwardly from the rear end of the projectile, a removable casing containing a percussion cap primer comprising the ignition means and fitting on the rear portion of the rocket engine, the launching device including a breech that can be opened to expose the rear end of the tubular launching device, the casing including a flange that prevents it from fitting through the tubular launching device, the projectile being inserted in the front end of the tubular launching device and the casing fitting partly into the rear end tubular launching device through the breech and being mounted on the rocket engine after the rocket engine has been inserted in the tubular launching device, the casing remaining in the tubular launching device after the projectile has been ignited and propelled from the tubular launching device.

5. A line throwing device according to claim 1 wherein the body of the projectile comprises an elongated cylindrical portion with a nose cone mounted at the front end thereof and stop means for preventing the fin assembly from sliding off the projectile positioned at the rear of the cylindrical portion, the fin assembly comprising a sleeve that fits over and slides axially along the cylindrical portion of the body, with stabilizing fins extending outwardly from spaced locations around the sleeve.

6. A line throwing device according to claim 5 wherein the nose cone includes a portion extending radially outwardly a sufficient distance to prevent the fin assembly from sliding off the front end of the projectile, the stop means comprising an outwardly extending portion at the rear end of the body that prevents the fin assembly from sliding off the rear end of the body.

7. A line throwing device according to claim 5 wherein the fin assembly includes at least four stabilizing fins equally spaced around the central portion of the fin assembly, two of the fins positioned on opposite sides of the central portion being harness fins and including harness attachment means for connecting the line to the projectile, a harness extending between and attached to the harness fins and having a looped central portion that trails behind the rocket while in flight, the end of the line being attached to the central portion of the harness such that the line is towed by the projectile from a centered position behind the rocket engine.

8. A line throwing device adapted to be launched from a tubular launching device such as a riot gun comprising:

a projectile including an elongated body shaped to fit in the tubular launching device and a fin assembly, including outwardly extending stabilizing fins, slidably mounted on the body for axial movement along the body, the fin assembly sliding forwardly to permit the rear end of the body to be positioned in the tubular launching device and sliding rearwardly to a flight stabilizing position as the projectile is launched from the tubular launching device;

rocket engine means mounted at the rear end of the projectile for propelling the projectile, the rocket engine means comprising a solid fuel rocket including an elongated tubular body retaining the solid fuel and a nozzle having an outlet opening therein positioned in the rear end of the body;

ignition means mounted at the rear end of the projectile for igniting the rocket engine, the ignition means comprising a casing that mounts on the rear end of the rocket, with a percussion primer cap being retained in the end of the casing adjacent the outlet opening in the nozzle, the primer cap being positioned by the casing such that manual ignition of the primer cap causes ignition of the rocket, the rocket propelling itself away from the casing and propelling the projectile away from the tubular launching device toward the desired target; and a line having one end that is carried by the projectile from the launching device to the projectile target area for rescue purposes or the like.

9. A line throwing device according to claim 8 wherein the casing includes a tubular shell portion that fits over the rear end of the rocket and a base plate positioned opposite the rear end of the rocket, the primer cap being mounted in the base plate, the casing including means for spacing the base plate and primer cap a predetermined distance from the end of the rocket when the rocket is fully inserted into the casing, the spacing being such as to facilitate ignition of the rocket with the primer cap.

10. A line throwing device according to claim 9 wherein the space between the primer cap and rocket nozzle is about one-tenth inch.

11. A line throwing device according to claim 8 wherein the percussion primer cap is a primer cap of the type used to fire a shotgun shell, the thrust force on the projectile being provided by the rocket as the projectile is propelled toward its target, thereby minimizing the backward reactive force caused by the ignition of the rocket on the tubular launching device.

12. A line throwing device according to claim 11 wherein the tubular launching device is a gun having a barrel, stock, firing pin and trigger, with the barrel of the gun being the tube into which the projectile fits, the gun having a breach that opens and closes at the rear end of the barrel, the casing fitting over the nozzle end of the rocket and having a portion that extends radially outwardly beyond the outer periphery of the rocket, the rocket and attached casing fitting into the gun barrel at the breach end with the casing being too wide to slide down the barrel, the percussion primer cap being positioned in the rear end of the casing such that it is struck and fired by the firing pin of the gun when the trigger is pulled with the breach closed, the rocket being fitted into the outer end of the barrel of the gun and extended inwardly until the rocket is nested in the rear end of the projectile, the rocket and projectile being propelled from the gun barrel on ignition, with the casing being retained in the breach of the gun.

13. A line throwing device according to claim 11 wherein the solid fuel of the rocket is positioned immediately in front of the nozzle and the solid fuel has an elongated recess therein that leads to the opening in the nozzle, the recess providing additional surface area for ignition of the solid fuel propelled by the primer cap.

14. A line throwing device according to claim 13 wherein the nozzle has a curved, outwardly flared outer end, and the opening in the nozzle is sufficiently large to permit ignition of the rocket with a primer cap without permitting premature ignition of the rocket fuel.

15. A line throwing device according to claim 14 wherein the rocket engine is a pre-programmed, variable thrust engine wherein the elongated recess in the solid fuel is tapered inwardly from the nozzle to an inner end of the recess, the rocket engine providing a strong initial thrust to give the projectile early aerodynamic stability and then providing a gradual, continuous thrust to carry the projectile at a controlled speed to its destination, such that aerodynamic stability is maintained during flight as line is withdrawn from the canister.

16. A line throwing device adapted to be launched from a tubular launching device such as a riot gun comprising:

a projectile including an elongated body shaped to fit in the tubular launching device and a fin assembly, including outwardly extending stabilizing fins, slidably mounted on the body for axial movement along the body, the fin assembly sliding forwardly to permit the rear end of the body to be positioned in the tubular launching device and sliding rearwardly to a flight stabilizing position as the projectile is launched from the tubular launching device;

rocket engine means mounted at the rear end of the projectile for propelling the projectile;

ignition means mounted at the rear end of the projectile for igniting the rocket engine; and a line having one end that is carried by the projectile from the launching device to the projectile target area for rescue purposes or the like, the line being coiled and housed in a canister that clips on the tubular launching device by a releasable and removable clip mechanism, one end of the line including means to clip the line to the projectile for carrying the line to a target, the line being coiled such that the line uncoils evenly when the end is pulled by the projectile, the tubular launching device being a conventional riot gun in the form of a rifle having a hand grip adjacent the trigger, with the bottom of the hand grip being a butt and a support flange extending rearwardly from the butt of the hand grip to the stock of the gun, the clip mechanism for mounting the canister to the gun including a quick release mounting clip comprising a cup that fits over the butt of the hand grip, the cup having an open rear end with flanges extending beyond the rear of the hand grip and above the support flange, a quick release pin extending through openings in said flanges and being positioned such that the cup portion is held on the butt of the hand grip when the pin is inserted but the cup portion is removable when the pin is removed, the quick release mounting clip further comprising an inverted, generally T-shaped flange extending downwardly from the cup portion, with the leg of the flange being attached to the cup portion and the arms extending outwardly from the bottom edge of the leg, the canister including mating slotted channel portions attached to the outer surface of the canister, the channel portions receiving and retaining the arms of the T-shaped flange and holding the canister to the gun with a front end of the canister facing forwardly in position for the line to be removed from the front of the canister as the projectile is propelled toward its target.

* * * * *